US007119330B2

(12) United States Patent
Kalinitchenko

(10) Patent No.: US 7,119,330 B2
(45) Date of Patent: Oct. 10, 2006

(54) PLASMA MASS SPECTROMETER

(75) Inventor: Iouri Kalinitchenko, Mulgrave (AU)

(73) Assignee: Varian Australia PTY LTD, Mulgrave (AU)

( * ) Notice: Subject to any disclaimer, the term of this patent is extended or adjusted under 35 U.S.C. 154(b) by 30 days.

(21) Appl. No.: 10/506,142

(22) PCT Filed: Feb. 27, 2003

(86) PCT No.: PCT/AU03/00242

§ 371 (c)(1),
(2), (4) Date: Aug. 31, 2004

(87) PCT Pub. No.: WO03/077280

PCT Pub. Date: Sep. 18, 2003

(65) Prior Publication Data

US 2005/0082471 A1 Apr. 21, 2005

(30) Foreign Application Priority Data

Mar. 8, 2002 (AU) ..... PS1005
Jul. 31, 2002 (AU) ..... 2002950505

(51) Int. Cl.
*H01J 49/40* (2006.01)

(52) U.S. Cl. ..... 250/288; 250/289; 250/281; 250/282; 250/292; 250/286; 435/4

(58) Field of Classification Search ..... 250/288, 250/289, 281, 282, 292
See application file for complete search history.

(56) References Cited

U.S. PATENT DOCUMENTS

| | | | | |
|---|---|---|---|---|
| 4,740,696 | A | 4/1988 | Osawa et al. | |
| 5,051,584 | A * | 9/1991 | Gray et al. | 250/288 |
| 5,767,512 | A | 6/1998 | Eiden et al. | |
| 6,265,717 | B1 * | 7/2001 | Sakata et al. | 250/289 |
| 6,545,270 | B1 * | 4/2003 | Speakman et al. | 250/288 |

FOREIGN PATENT DOCUMENTS

| | | |
|---|---|---|
| EP | 0 813 228 A1 | 12/1997 |
| JP | 10-040857 | 2/1998 |

* cited by examiner

*Primary Examiner*—Nikita Wells
*Assistant Examiner*—Zia R. Hashmi
(74) *Attorney, Agent, or Firm*—Bella Fishman; Edward Berkowitz

(57) ABSTRACT

A plasma source mass spectrometer (20) having an ion beam extraction electrode (45) associated with a skimmer cone (40) to restrict the pumping of gas from a region (60) immediately behind the skimmer cone orifice (42) to provide a higher pressure (e.g. $1–10^{-2}$ Torr) in the region (60) compared to the pressure downstream of the electrode (45) (e.g. $10^{-3}–10^{-4}$ Torr). This provides a collisional gas volume (60) for plasma (28) for attenuating polyatomic and multi-charged interfering ions prior to extraction of an ion beam (49). In one embodiment a substance (e.g. hydrogen) can be supplied into the region (60) to assist attenuation of poly-atomic and multicharged interfering ions by reactive or collisional interactions.

11 Claims, 3 Drawing Sheets

PLASMA MASS SPECTROMETER

TECHNICAL FIELD

The present invention relates to a spectrometer that uses a plasma ion source for elemental and isotopic analysis such as, for example, an Inductively Coupled Plasma Mass Spectrometer (ICP-MS), a microwave induced plasma mass spectrometer or laser induced plasma mass spectrometer.

BACKGROUND OF THE INVENTION

The following discussion of the background to the invention is included to explain the context of the invention. This is not to be taken as an admission that any of the material referred to was published, known or part of the common general knowledge in Australia as at the priority date of any of the claims of this specification An ICP-MS typically employs an inductively coupled argon plasma (ICP) as an ionisation source and a mass-analyser to separate and measure analyte ions formed in that source. Normally, a sample for analysis is first taken into solution and this solution is pumped into a nebuliser to generate a sample aerosol. The sample aerosol passes into the ICP, where it is atomised and ionised. The plasma is at a relatively high pressure (typically but not necessarily atmospheric pressure, 760 Torr). The resulting ions are then transferred from the plasma via a differentially-pumped interface to a mass-analyser operating at a very low pressure (typically $<10^{-5}$ Torr). Typically, ions from the plasma enter a first orifice at the tip of a conical body (often called the sampling cone) and then pass through a second orifice, coaxial with the first orifice, at the tip of a second conical body (often called the skimmer cone). The space between the two orifices (a first vacuum chamber) is maintained at a low pressure (1–10 Torr).

The skimmer cone orifice opens into a second vacuum chamber, where the pressure is maintained at around $10^{-3}$–$10^{-4}$ Torr. The ions are extracted from the plasma emerging from the second orifice and focused by ion optics into a mass-analyser, which is located in a third vacuum chamber where the pressure is maintained at $10^{-5}$–$10^{-6}$ Torr.

The mass-analyser separates the ions based on their mass-to-charge ratio, and the separated ions are detected by an ion detection system. The efficiency of the ion extraction/transfer process from the downstream side of the skimmer cone orifice to the ion detector is typically 0.2% or less [1, p. 798].

Ion beam extraction and acceleration towards the mass-analyser typically involve the use of an electrostatic extraction electrode or series of electrodes (hereinafter sometimes alternatively termed "lens") located downstream of the skimmer cone. To reduce losses, extraction lenses are designed to promote unrestricted pumping from the region immediately downstream of the skimmer cone, where the ion beam is extracted from the plasma. This is to reduce gas molecules in this region, as it is recognised in the art that acceleration of ions through a background gas can lead to losses of ions by scattering, as ions collide with molecules of the background gas. In order to minimise such loses an aerodynamically shaped conical extraction lens may be used as a part of the interface design [2]. This arrangement allows effective removal of gas molecules though the space around the extraction electrode or lens and provides minimum disturbance of the gas flow. Another approach to avoiding disturbance of the gas flow by the extraction electrode or lens and to ensuring adequate pumping efficiency behind the skimmer cone is to place the extraction lens away from the skimmer cone. Yet another approach is to make the extraction lens from coarse mesh grid.

It is known that ICP-MS measurements can be subject to spectroscopic interferences. For example, polyatomic ions, such as $ArO^+$, $Ar_2^+$, $OCl^+$ overlap with major isotopes of $Fe^+$, $Se^+$, and $V^+$ respectively, which makes it very difficult to produce reliable analytical results for trace levels of these elements. Other spectroscopic interferences in ICP-MS arise from metal oxide ions. The extent to which such oxide ions are present is monitored by measuring the ratio of cerium oxide ion ($CeO^+$) to cerium ion ($Ce^+$) in the mass spectrum of a sample containing a specified known concentration of cerium. This test is used because cerium oxide ion is the most stable of the common oxide ions. Still other spectroscopic interferences in ICP-MS arise from multicharged metal ions. The extent to which such multicharged ions are present is monitored by measuring the ratio of doubly-charged barium ion ($Ba^{++}$) to singly-charged barium ion ($Ba^+$) in the mass spectrum of a sample containing a specified known concentration of barium. This test is used because doubly-charged barium is one of the most readily formed of the common multicharged ions. An ICP-MS system that shows simultaneously low values for the $CeO^+/Ce^+$ ratio and the $Ba^{++}/Ba^+$ ratio is advantageous because spectroscopic interferences are thereby kept low.

It is known that the effects of some polyatomic ions in ICP-MS can be greatly improved by employing various collision cell techniques [3]. A gas introduced into a multipole ion guide between the interface and the mass-analyser helps to reduce the population of some polyatomic species in the ion beam before the ions enter the mass-analyser. However, this technique is complex and relatively expensive.

U.S. Pat. No. 5,767,512 entitled "Method for Reduction of Selected Ion Intensities in Confined Ion Beams" [4] discloses a method for producing an ion beam having an increased ratio of analyte ions to carrier gas ions by introducing an additional reagent gas downstream of the skimmer cone, thus inducing selective collisional charge transfer.

U.S. Pat. No. 6,265,717 entitled "Inductively Coupled Plasma Mass-spectrometer and Method" [5] describes an ICP-MS interface with a controller for increasing the pressure in the interface (that is, in the enclosure between the sampling and skimmer orifices). This promotes collisions that selectively remove interfering ions. Alternatively, according to the same patent, the local pressure in the interface can be modified by changing the design of the sampling and/or skimmer cone. For example, the sampling cone is modified to give a narrower apex inside the tip. Ions extracted into this narrow apex undergo more collisions because the expansion of the ion beam is restricted.

SUMMARY OF THE INVENTION

As described above, conventional ICP-MS instruments are provided with an interface designed to minimise pumping restriction in the region where the ion extraction process occurs. The shape and location of the extraction electrode or electrodes (that is the extraction lens or lenses) allow easy removal of gas from the extraction region by a vacuum pump. The present invention, to the contrary, provides an ion beam extraction electrode which restricts the removal of gas from a region between the skimmer cone orifice and the extraction electrode, that is, the extraction of gas in the region where the ion extraction process occurs is restricted such that that region will have a relatively higher pressure (eg. 1–$10^{-2}$ Torr) compared to the pressure downstream of the extraction electrode (eg. $10^{-3}$–$10^{-4}$ Torr). Although the invention is described herein in relation to an ICP-MS, it is also applicable to other plasma source mass spectrometers, for example microwave plasma mass spectrometers or laser induced plasma mass spectrometers.

Accordingly, in a first aspect the present invention provides a mass spectrometer including a plasma ion source for providing analyte ions, a vacuum chamber, and a sampling and a skimmer interface arrangement between the plasma ion source and the vacuum chamber for admitting plasma which contains analyte ions into the vacuum chamber, electrode means in the vacuum chamber for extracting an ion beam containing analyte ions from the admitted plasma for transmission to a mass analyser and ion detector contained in a further vacuum chamber, the electrode means including at least one electrode which is configured and associated with the skimmer such that a region of the vacuum chamber between the skimmer and said at least one electrode will have a relatively higher pressure than the pressure elsewhere in the vacuum chamber thereby to provide a collisional gas volume for attenuating polyatomic and multicharged interfering ions.

Thus, in an embodiment of the invention, an ICP-MS interface having a conventional sampling cone and skimmer cone arrangement incorporates an ion beam extraction electrode or lens that acts as a gas baffle, or physical aperture, or as a pumping restriction to create a gas volume between the tip of the skimmer cone and the extraction lens (that is, said region of the vacuum chamber) characterised by a relatively high pressure (compared to that in conventional systems) of about 1–$10^{-2}$ Torr. Restriction of the pumping of gas from this region or volume by the presence of the extraction lens establishes an equilibrium operating pressure therein of about 1–$10^{-2}$ Torr. The pressure downstream of the lens is in the range $10^{-3}$–$10^{-4}$ Torr.

The plasma entering said region (that is, the above-mentioned gas volume) through the skimmer orifice is converted to an ion beam under the influence of the electrostatic field of the extraction electrode. Simultaneously, because of the relatively high pressure in this region, the plasma undergoes significant collisional interaction with gas molecules. The extraction of the ion beam from the collisional plasma in the region gives improved detection limits by improving analyte ion sensitivity and by reducing the presence of polyatomic and multicharged ions in the mass spectra. Without wishing to be bound by a particular theory or model, it is speculated that polyatomic and multicharged ions are selectively attenuated by collisions inside the gas volume created in the region between the skimmer orifice and the extraction electrode. Spectral interferences are reduced, which results in better limits of detection.

Preferably, in the first aspect of the invention the skimmer has a conical interior surface and the at least one electrode is mounted on the conical interior surface of the skimmer and electrically insulated therefrom whereby said region of the vacuum chamber is a volume defined by the conical interior surface and the at least one electrode.

Preferably the at least one electrode is formed as a plate having a central aperture.

Preferably the electrode means additionally include an annular electrode located after the plate electrode. Alternatively an annular electrode may be located before the plate electrode such that it is within said region of the vacuum chamber.

Alternatively the electrode means including the at least one electrode may be a plurality of plate electrodes having aligned central apertures.

In a second aspect of the invention the interface arrangement preferably includes a passage for supplying a substance into said region for interaction with the plasma that passes through the skimmer for assisting attenuation of polyatomic and multicharged interfering ions (by reactive or collisional interactions).

The substance for supply into the region through the passage can be any one or a mixture of those which are known and have previously been used for attenuating interfering polyatomic or multicharged ions by reactive and collisional phenomena. Generally the substance or a mixture of substances may be chosen to remove selectively particular interferences, as is known. Hereinafter such a substance is termed a "reaction/collision substance". The substance(s) may be a gas (for example nitrogen, hydrogen, oxygen, xenon, methane, propane, ammonia, helium). This embodiment of the present invention will be described and illustrated using hydrogen gas as a reactive/collision substance. It is to be understood, however, that any physical form of any substance(s) capable of delivering the desired interference attenuation effect may be introduced into the plasma in the manner disclosed by the present embodiment.

In this embodiment the reaction/collision substance is supplied into the plasma as such and not into an ion beam that has been extracted from the plasma, as in the prior art. This means that the plasma electrons are available to assist in attenuating the interfering ions through electron-ion dissociative recombination. The presence of plasma electrons also significantly reduces the generation of secondary products from the interference attenuating reactions, for example, for hydrogen added to an argon plasma there is very little (if any) increase in the numbers of $ArH^+$ or $H_3^+$ ions.

The reaction/collision substance may be supplied into said region sufficiently smoothly as to cause substantial stagnation of the plasma without inducing a shock wave. The purpose of this is to increase the residence time of the plasma within said region and thus possibly increase the efficiency of attenuation of interfering ions.

For a better understanding of the invention and to show how it may be performed, preferred embodiments thereof will now be described, by way of non-limiting example only, with reference to the accompanying drawings.

DESCRIPTION OF PREFERRED EMBODIMENTS OF THE INVENTION

Figure 1:
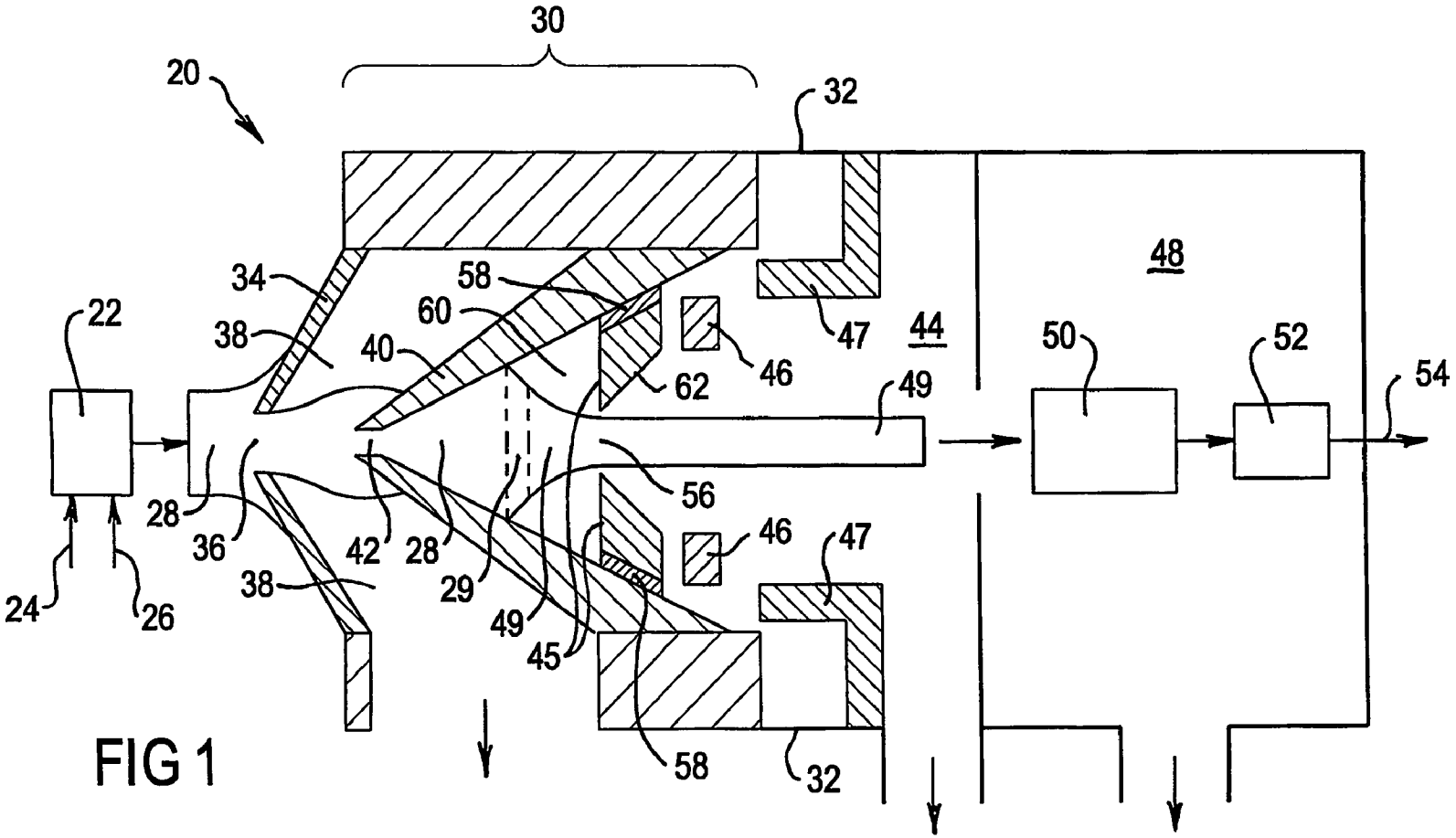
FIG. 1 shows a sectional view of a preferred embodiment of a mass spectrometer according to the invention, showing an ICP-MS interface portion using a modified extraction electrode in greater detail than remaining portions which are shown schematically.

FIGS. 1 to 4 schematically illustrate ICP-MS embodiments of the invention, however it is to be understood that the invention relates to a mass spectrometer having a plasma ion source in which the plasma may be generated other than by radio frequency inductive coupling. Throughout FIGS. 1 to 4, the same reference numeral is used to denote corresponding components or features in the different embodiments.

FIG. 1 illustrates an ICP-MS 20 that includes a plasma ion source 22 (namely an inductively coupled plasma torch, which is shown only schematically, to which a plasma forming gas 24, for example argon is supplied as well as a nebulized sample (analyte) 26 contained in a carrier gas). As is known, source 22 produces an atmospheric pressure plasma 28 containing analyte ions. ICP-MS includes an interface arrangement 30 via which plasma 28 admitted into the mass analysing part of the spectrometer 20.

The interface arrangement 30 includes a sampling cone 34 having an orifice 36 (typically approximately 1 mm in diameter) at its apex through which some plasma 28 at atmospheric pressure passes into a first pumped vacuum region 38 (typically at a pressure of 1–10 torr). The interface arrangement 30 further includes a skimmer cone 40 having an orifice 42 (typically approximately 0.5 mm in diameter) at its apex through which some plasma 28 passes from the first vacuum region 38 into a second pumped vacuum region 44 (typically at a pressure of $10^{-3}$–$10^{-4}$ torr) within a vacuum chamber 32. The sampling and skimmer cones 34, 40 are typically water-cooled. Second vacuum region 44 of vacuum chamber 32 includes an electrode means, namely an ion extraction electrode 45 plus other electrodes 46 and 47 (described in further detail below) for extracting an ion beam 49 from the plasma 28 passing through hole 42 of skimmer cone 40 and directing it into a third pumped vacuum region 48 (typically at a pressure of $10^{-5}$–$10^{-6}$ torr). and into a mass analyser 50 (for example, a quadrupole mass analyser, which is only schematically illustrated) in region 48. Mass analyser 50 separates the ions according to their mass to charge ratio and those that pass through the mass analyser 50 are detected by a detector 52 (for example, an electron multiplier, which is only schematically illustrated) and read out (54) by a suitable recording means (not shown).

Thus a path between plasma 28 and first vacuum region 38 is provided by sampling cone orifice 36 in sampling cone 34. From first vacuum region 38, plasma 28 is transferred into second vacuum region 44 of chamber 32 by skimmer cone 40 through skimmer cone orifice 42. Electrostatic electrode (i.e. lens) 45, which is formed as a plate, produces an electrostatic field, which extracts ions into ion beam 49 from plasma 28, particularly from plasma boundary 29. The lens or electrode 45 contains a single axial aperture 56, typically 1–7 mm in diameter. Lens or electrode 45 is mounted to the interior surface of skimmer cone 40 using dielectric seal 58 such that it is electrically insulated therefrom. A second electrostatic lens or electrode 46 and a third electrostatic lens or electrode 47 assist the formation of a focused ion beam 49.

Thus the electrode 45 is configured and associated with the skimmer cone 40 to define a volume which provides a region 60 that the neutral species that form part of plasma 28 cannot be evacuated from, except through the axial aperture 56 in electrode 45. Therefore, the electrode 45 acts as a gas baffle and restricts the efficiency of pumping from the region 60 to achieve a pressure of, for example, 1–$10^{-2}$ Torr (instead of $10^{-3}$–$10^{-4}$ Torr, as known in the prior art [6]). The higher pressure in the region 60 promotes collisions where plasma 28 is contained. The extra collisions attenuate interferences according to the invention.

The electrode means 45, 46, 47 are formed to provide electrostatic fields that are shaped to facilitate extraction and formation of the ion beam 49. Thus plate electrode 45 is followed by annular or ring electrode 46 which is followed by electrode 47 in the form of a cylinder having an outwardly directed flange. The aperture 56 through plate electrode 45 may be outwardly tapered as at 62 to facilitate penetration of the electrostatic field for forming the ion beam 49.

Figure 2:
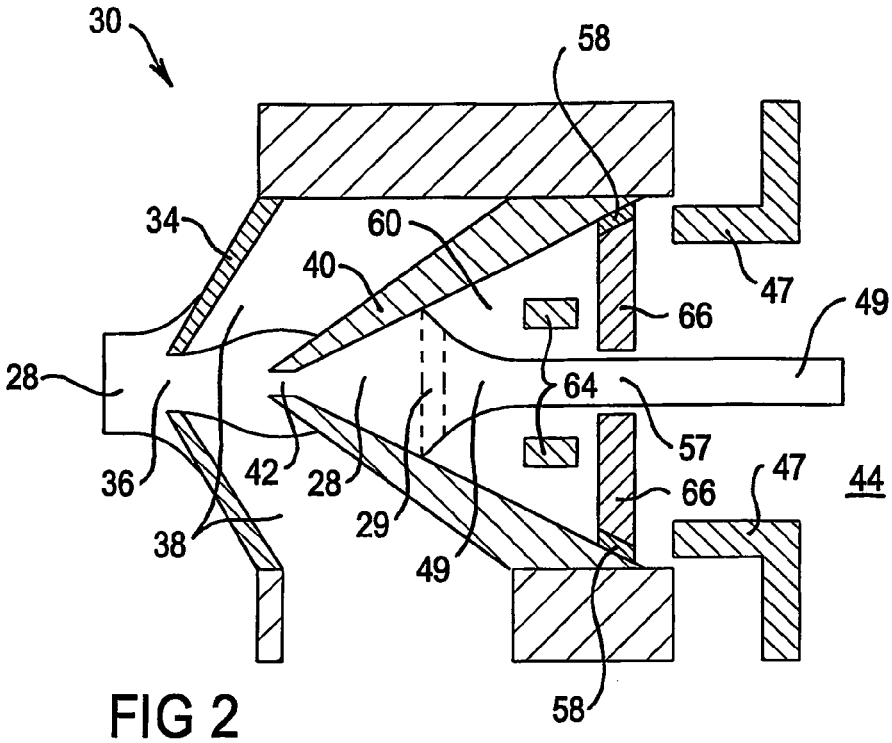
FIG. 2 shows a sectional view of a second embodiment of a portion of the invention, namely an ICP-MS interface using an alternative modified extraction electrode means.

FIG. 2 shows an interface 30 of another embodiment of an ICP-MS according to the invention. The interface 30, which includes a first vacuum region 38 at pressure typically 1–10 Torr, separates a second vacuum region 44 at pressure typically $10^{-3}$–$10^{-4}$ Torr from the atmospheric pressure plasma 28. A path between plasma 28 and first vacuum region 38 is provided by sampling cone orifice 36 in sampling cone 34. From first vacuum region 38, plasma 28 is transferred into second vacuum region 44 by skimmer cone 40 through skimmer cone orifice 42. Annular electrostatic lens or electrode 44 45 produces an electrostatic field, which extracts ions into beam 49 from plasma 28, particularly from plasma boundary 29. A second plate-like electrostatic lens or electrode 66 and a third cylindrical plus flange electrostatic lens or electrode 47 (as in FIG. 1) assist the formation of a focused ion beam 4. Second lens 66 has an axial orifice 56 typically 1–7 mm in diameter to function as a gas baffle. Lens 66 is attached to the interior wall of skimmer cone 40 using a dielectric seal 58. Region 60 enclosed by skimmer cone 40 and electrode 66 can not be evacuated except through axial orifice 56. Lens or electrode 66 thus acts as a gas baffle and restricts the efficiency of pumping from the region 60 to achieve pressures in the range 1–$10^{-2}$ Torr (instead of $10^{-}$–$10^{-4}$ Torr, as known in the prior art). The higher pressure promotes collisions in region 60 where plasma 28 is contained. The extra collisions attenuate interferences according to the invention.

Figure 3:
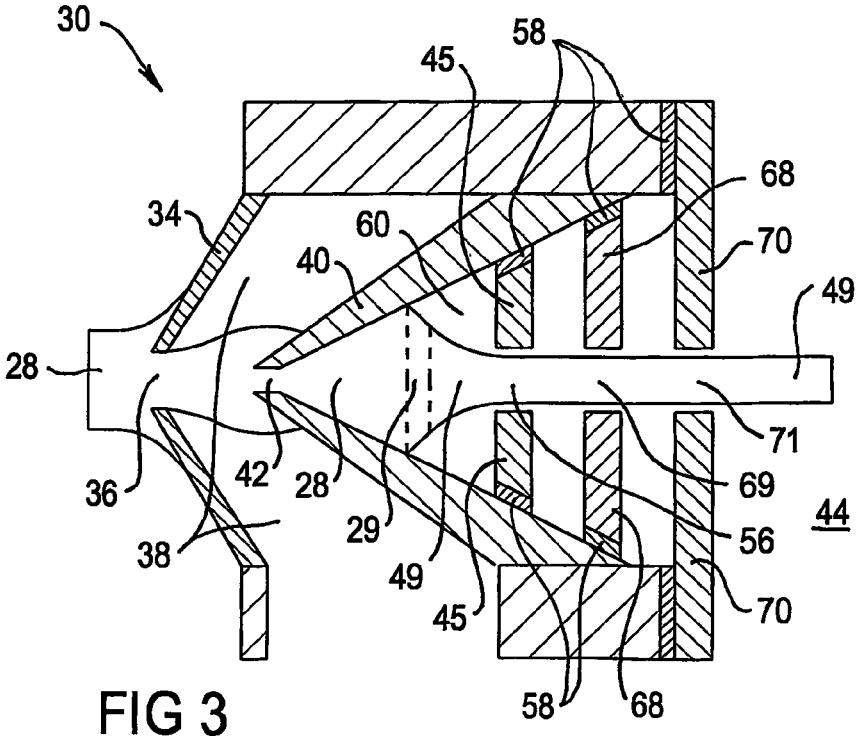
FIG. 3 shows a sectional view of a third embodiment of a portion of the invention, namely an ICP-MS interface using a number of extraction electrodes.

FIG. 3 shows an interface 30 of another embodiment of an ICP-MS according to the invention. This interface 30, which includes a first vacuum region 38 at pressure typically 1–10 Torr, separates a second vacuum region 44 at pressure typically $10^{-3}$–$10^{-4}$ Torr from the atmospheric pressure plasma 28. A path between plasma 28 and first vacuum region 38 is provided by sampling cone orifice 36 in sampling cone 34. From first vacuum region 38, plasma 28 is transferred into second vacuum region 44 by skimmer cone 40 through skimmer cone orifice 42. Electrostatic lens 45, which is formed as a plate, produces an electrostatic field, which extracts ions into ion beam 49 from plasma 28, particularly from plasma boundary 29. A second electrostatic lens 68 and a third electrostatic lens 70, both formed as plates, assist the formation of a focused ion beam 49. Extraction lens 45, second lens 68 and third lens 70 all have axial orifices respectively 56, 69, 71, typically 1–7 mm in diameter to allow said lenses to function as gas baffles. Lenses 45, 68 and 70 are attached to the walls using a dielectric seal 58 to electrically insulate them. Region 60 can not be evacuated except through the axial orifices 56, 69, 71. Lens 45 acts as a first baffle, lens 68 acts as a second baffle and lens 70 acts as a final gas baffle. The lenses 45, 68, 70 act simultaneously to restrict the efficiency of pumping from the volume region 60 to achieve pressures in the range 1–$10^{-2}$ Torr (instead of $10^{-3}$–$10^{-4}$ Torr, as known in the prior art). The higher pressure promotes collisions in region 60 where plasma 28 is contained. The advantage of this embodiment in comparison to those shown in FIG. 1 and FIG. 2 is that extra collisions occur in the ion path between lenses 45 and 70, resulting in even greater attenuation of polyatomic ions according to the invention. It is to be understood that while the number of lenses (electrodes) shown in this illustrative example is three, other numbers of lenses (electrodes) can be used.

Figure 4:
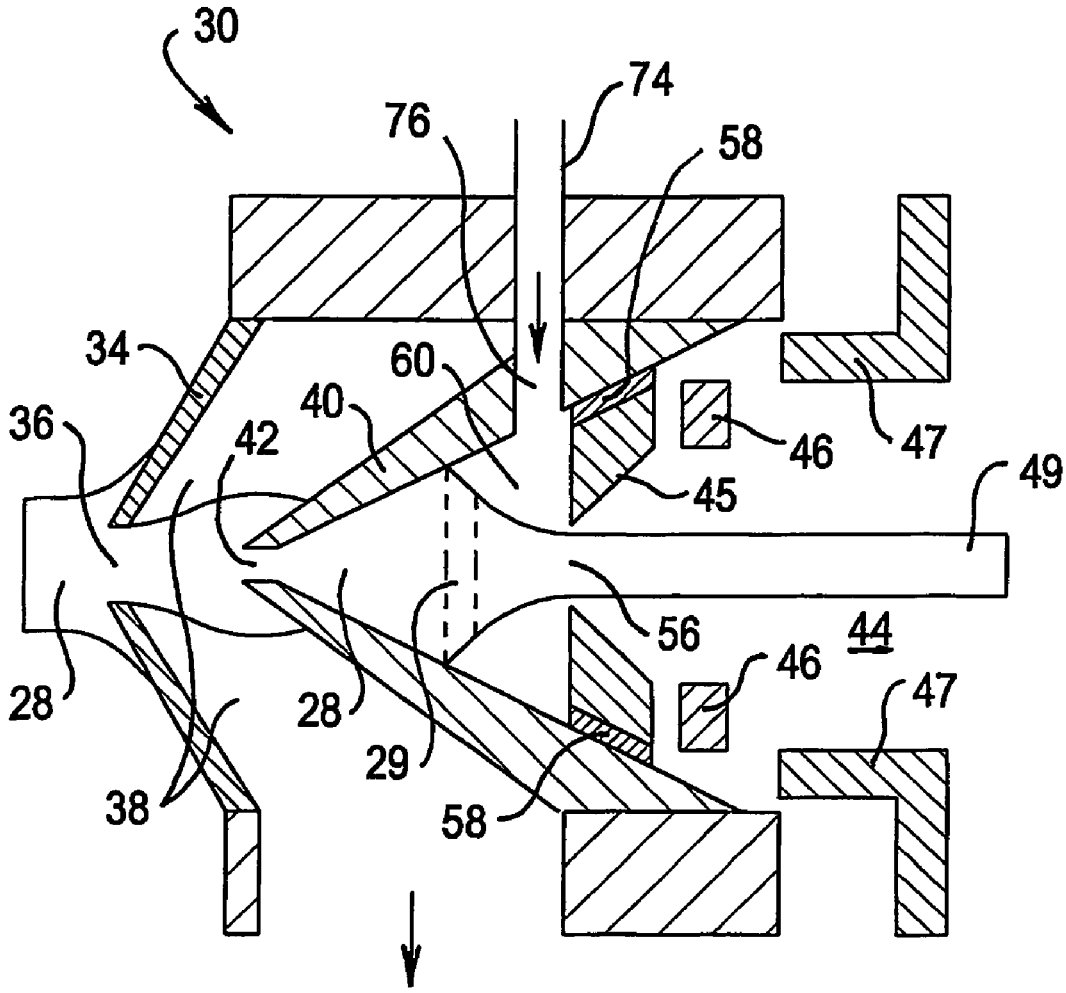
FIG. 4 shows a sectional view of another embodiment of a portion of the invention, namely an ICP-MS interface arrangement that includes a passage for supplying a reaction/collision substance.

FIG. 4 illustrates a portion of a mass spectrometer similar to the FIG. 1 embodiment that incorporates a modification to create a collision/reaction zone. In this embodiment, as in the FIG. 1 embodiment, the ion extraction electrode 45 is mounted to the inner wall of skimmer cone 40 by a dielectric seal 58 and effectively acts as a gas baffle to restrict pumping from the region 60 encompassed between the skimmer cone 40 and the ion extraction electrode 45. Additional ion optics, that is second and third electrodes 46, 47 assist ion extraction electrode 45 (which repels electrons from plasma boundary region 29) in forming a focussed ion beam 49. The region 60, because of the restricted pumping therefrom via the orifice 56 through ion extraction electrode 45 (which is typically 1–7 mm in diameter) will have a pressure therein between that in vacuum region 38 and vacuum region 44. This pressure may typically be in the range 0.1–1 torr. If no additional gas be introduced into region 60, the pressure therein is set by the ratio of the area of the entrance aperture 42 to that of the exit aperture 56, and the rate at which gas is pumped from vacuum region 38. Region 60 has an entrance aperture (that is, the opening cross-sectional area of orifice 42 through skimmer cone 40) through which the plasma 28 flows from the higher pressure region 38 towards the lower pressure region 44 and substantially fills the volume 60. The pressure in region 60 may be adjusted by introducing a reaction/collision substance into the region. The reaction/collision substance is supplied effectively directly into the plasma 28 in volume 60 via an inlet 74 and passage 76 of the interface arrangement 30. Some interference-attenuating reactions/collisions may occur within the volume 60, but most favourable conditions for such collisions exist close to the orifice 42 where the plasma 28 is at relatively high density. In addition, the plasma density in orifice 42 can be increased by increasing pressure in region 60. The increased plasma density would lead to more efficient attenuation of interfering ions. It is also noteworthy that an increased pressure in region 60 can reduce the spread of ion energies in the plasma 28 and consequently in the extracted ion beam 49. This assists the production of a better focused ion beam 49, which in turn can lead to a significant increase in analytical sensitivity.

An embodiment of the present invention according to FIG. 4 allows additional control of the gas pressure in the region 60 for the optimisation of interference suppression. This also permits a significant reduction in the amount of a reaction/collision gas that is introduced compared to previously known methods wherein a reaction/collision gas is introduced either directly into a vacuum region or indirectly via an ICP torch. This is because a substantial portion of the reaction/collision gas in such previously known methods is simply pumped away by the vacuum system without ever participating in the necessary reactions, whereas according to the FIG. 4 embodiment of the present invention a reaction/collision gas is introduced directly into the sampled plasma 28 prior to the extraction of an ion beam 49 therefrom.

EXAMPLE OF THE PERFORMANCE OF THE INVENTION

An ICP-MS instrument was equipped with an interface according to the present invention (FIG. 1). Performance achieved using a conventional pneumatic concentric nebulizer and a double-pass, Scott-type water-cooled spray chamber sample introduction system showed very high sensitivity combined with low background, relatively low interferences and good stability:

Sensitivity for analyte ions:

$^{9}Be^{+}$=50–100 million counts per second per mg/litre $^{115}In^{+}$=1000–1500 million counts per second per mg/litre $^{232}Th^{+}$=700–1000 million counts per second per mg/litre Background: 1 count per second Short term stability: RSD=0.5%

Interferences tests, on the same instrument, of a conventional extraction lens having a conventional, unrestricted pumping showed that interferences were worse with this conventional lens than with a lens according to the invention.

| Interference ratio | Conventional extraction lens | Lens according to the invention |
|---|---|---|
| $CeO^{+}/Ce^{+}$ | 2%–3% | 0.5%–1% |
| $Ba^{++}/Ba^{+}$ | 1%–3% | 1%–2% |
| $(ArOH)^{57}$/10 ppb $^{59}Co$ | 0.33 | 0.01 |
| $(ArAr)^{78}$/10 ppb $^{115}In$ | 0.022 | 0.01 |

Efficiency of the Interface

According to Hongsen Niu and R. S. Houk the efficiency of a typical (i.e. prior art) ICP-MS interface is very low. ([1, p. 798.] Only 1 in every 500 or perhaps every 5000 analyte ions that enter the second vacuum chamber through the skimmer cone orifice reaches the detector. This is an efficiency of only 0.2–0.02%. Suggested reasons for this poor efficiency include reduced transmission of ions through the skimmer cone because of gas flow disturbances at the tip of the skimmer [1,7] and/or just downstream of the skimmer tip [1], and space charge effects during the extraction of the ion beam from the plasma behind the skimmer cone [1].

Analysis of experimental results obtained with an interface according to the present invention suggests that the transport efficiency of analyte ions may be much higher than reported by Niu and Houk [1] for a prior art system. The following analysis of experimental results follows that of Niu and Houk [1, p. 798].

Consider a sample solution containing 0.01 mg/litre of an analyte element having an atomic weight of 100 g/mol. With a Varian Sturman-Masters spray chamber, fitted with a conventional concentric glass pneumatic nebulizer operated at a solution feed rate of 1 millilitre/minute and a nebulizer gas flow of 1 litre of argon per minute, no more than about 2% of the solution taken into the nebulizer will reach the plasma. If the efficiency of ionization is close to 100%, and the gas kinetic temperature of the 1.2 kW plasma is around 5000 K, the resulting density of analyte ions ($M^{+}$) in plasma will be no more than about $7\cdot10^{7}$ $M^{+}$ ions·$cm^{-3}$ and the total number density in the plasma source will be about $1.5\cdot10^{18}$ $cm^{-3}$. The total gas flow through the sampler cone orifice (1 mm in diameter) is about $8.5\cdot10^{20}$ atoms $s^{-1}$ and the maximum flow of analyte ions is about $4.0\cdot10^{10}$ ions $s^{-1}\cdot(7\cdot10^{7}$ $M^{+}$ $cm^{-3}/1.5\cdot10^{18}$ $cm^{-3}\times8.5\cdot10^{20})=4.0\cdot10^{10}$ $M^{+}$ $s^{-1}$.

The total gas flow through a skimmer cone orifice 0.5 mm in diameter is about 0.25% of the flow through the sampler cone. This results in an expected analyte ion flow out of the skimmer cone of about $1\cdot10^8$ $M^+$ ions $s^{-1}$ for a 0.01 mg/litre sample solution.

The collisional scattering loss in the second vacuum chamber, at a pressure of $4\cdot10^{-4}$ Torr, is estimated to be around 50%. The second vacuum chamber of the experimental instrument contains ion optics elements to transport ions downstream to the entrance aperture of the mass analyser. If it is assumed that the ion beam carrying $1\cdot10^8$ $M^+$ ions $s^{-1}$ from the interface has been focused into mass-analyser entrance aperture and that there were no other loses except collisional scattering in the second chamber, it would be expected that $5\cdot10^7$ $M^+$ analyte ions would enter the mass analyser every second to be processed.

Computer simulations of the quadrupole mass analyser used in the experimental instrument indicate an ion transmission efficiency of about 50%. If it be assumed that there were no collisional scattering of ions by the residual gas in the third vacuum chamber that houses the mass-analyser, a maximum ion count rate of $2.5\cdot10^7$ ions per second for a 0.01 mg/litre solution is expected from the experimental instrument.

Tests showed that the experimental instrument having an interface according to the present invention had a sensitivity for indium equivalent to as much as $1.5\cdot10^7$ ions per second for a 0.01 mg/litre solution. This indicates that the efficiency of the ion transport and ion extraction process from the plasma behind the skimmer must be approaching 60%, if the nebulizer/spray chamber efficiency is around 2% and if the assumptions about the losses in the second chamber and the mass analyser are correct. The efficiency of transmission of ions from the skimmer cone to the detector is evidently at least $(1.5\cdot10^7)/(1\cdot10^8)$, or around 15%. This contrasts remarkably with the 0.2–0.02% efficiency of the corresponding part of the prior art systems discussed by Niu and Houk [1]. Simultaneously, relatively low polyatomic interferences and low doubly charged interferences have been achieved.

Experimental Tests with FIG. 4 Embodiment

A conventional ICP-MS instrument was modified as shown by FIG. 4. The reaction/collision substance used for the experiments was hydrogen but it should be understood that in principle any substance or species capable of interacting with interfering ions may be used in accordance with the present invention.

Signals for many ions that are potential interferences in ICP-MS were monitored during the experiments. Special attention was given to $^{40}Ar^+$, $^{40}Ar^{12}C^+$, $^{40}Ar^{16}O^+$, $^{40}Ar^{16}O^1H^+$, $^{40}Ar^{35}Cl^+$, and $^{40}Ar^{40}Ar^+$. Significantly better attenuation than that reported [U.S. Pat. No. 6,259,091 col. 14, line 17] for prior art according to Table 1 was found for all these ions. The improvement in detection limits for $^{40}Ca$, $^{52}Cr$, $^{56}Fe$, $^{57}Fe$, $^{75}As$, and $^{80}Se$ over those reported for the prior art according to Table 2 (below) was also good. Most significantly, it was found that introduction of aqueous samples containing up to 5% (by volume) concentrated hydrochloric acid did not produce the increase in Cl-based interfering ions that would be expected with a conventional ICP-MS instrument. This means that the efficiency of the attenuation of interferences grows at the same rate as the concentration of potentially interfering species. This in turn means that reliable signals for analyte ions can be detected in the presence of parent elements of potentially interfering ions, irrespective of variable concentrations of those elements in the sample solutions.

Results for the attenuation of $^{40}Ar^{16}O^+$, $^{40}Ar^{35}Cl^+$, and $^{40}Ar^{40}Ar^+$ interferences by using hydrogen as a reactive gas are presented in Table 1.

TABLE 1

| Interference | Isotope subject to interference | Interference reduction by prior art (U.S. Pat. No. 6,259,091) | Interference reduction by the embodiment of FIG. 4 |
|---|---|---|---|
| $^{40}Ar^{16}O^+$ | $^{56}Fe$ | 2 | 30 |
| $^{40}Ar^{16}O^1H^+$ | $^{57}Fe$ | not reported | 50 |
| $^{40}Ar^{35}Cl^+$ | $^{75}As$ | not reported | 50 |
| $^{40}Ar^{40}Ar^+$ | $^{80}Se$ | 5 | 100 |

The invention described herein is susceptible to variations, modifications and/or additions other than those specifically described and it is to be understood that the invention includes all such variations, modifications and/or additions which fall within the scope of the following claims.

REFERENCES

1. Hongsen Niu, R. S. Houk, "Fundamental Aspects of Ion Extraction in Inductively Coupled Plasma Mass-spectrometry", Spectrohimica Acta Part, B 51, (1996), 779–815.
2. K. Sakata, N. Yamada and N. Sugiyama, "Ion Trajectory Simulation of Inductively Coupled Plasma Mass-Spectrometry Based on Plasma-interface Behaviour", Spectrochimica Acta, Part B, 56, (2001), 1249–1261.
3. V. I. Baranov and S. D. Tanner, "A Dynamic Reaction Cell for Inductively Coupled Plasma Mass Spectrometry (ICP-DRC-MS), Part 1: The rf-field energy contribution in thermodynamics of ion-molecule reactions," Journal of Analytical Atomic Spectrometry, 14, 1133–1142, (1999).
4. G. C. Eiden, C. J. Barinaga and D. W. Koppenaal, U.S. Pat. No. 5,767,512, "Method for Reduction of Selected Ion Intensities in Confined Ion Beams" (Jun. 16, 1998).
5. K. Sakata, N. Yamada, R. Midorikawa, J. C. Wirfel, D. L. Potter, A. G. G. Martinez, U.S. Pat. No. 6,265,717, "Inductively Coupled Plasma Mass-spectrometer and Method" (Jul. 24, 2001).
6. J. Speakman, R. C. Haines, P. J. Turner, T. O. Merren, A. Jarvis, U.S. Pat. No. 6,222,185 B1, "Plasma Mass Spectrometer, (Apr. 24, 2001).
7. M. Chambers, J. Poehlman, P. Yang and G. M. Hieftje, "Fundamental Studies of the Sampling Process in an Inductively Coupled Plasma Mass Spectrometer—1. Langmuir Probe Measurements', Spectrochimica Acta part B, 46 (1991), 741–760.

The invention claimed is:

1. A mass spectrometer including:

a plasma ion source for providing analyte ions, a vacuum chamber, and a sampling and a skimmer interface arrangement between the plasma ion source and the vacuum chamber for admitting plasma which contains analyte ions into the vacuum chamber, electrode means in the vacuum chamber for extracting an ion beam containing analyte ions from the admitted plasma for transmission through an aperture in said electrode means to a mass analyser and ion detector contained in a further vacuum chamber, the electrode means including at least one electrode which is configured and associated with the skimmer such that a region of the vacuum chamber between the skimmer and said at least one electrode will have a relatively higher pressure than the pressure elsewhere in the vacuum chamber thereby to provide a collisional gas volume for attenuating polyatomic and multicharged interfering ions, wherein the skimmer has a conical interior surface and said at least one electrode is sealingly mounted on the conical interior surface of the skimmer and electrically insulated therefrom whereby said region of the vacuum chamber is a volume defined by the conical interior surface and the at least one electrode.

2. A mass spectrometer according to claim 1, wherein said at least one electrode is formed as a plate having a central aperture.

3. A mass spectrometer according to claim 2, wherein the central aperture in said at least one electrode is sized relatively to the size of the skimmer cone orifice for said region of the vacuum chamber to have a pressure therein of about $1–10^{-2}$ Torr compared to a pressure of about $10^{-3}–10^{-4}$ Torr elsewhere in the vacuum chamber.

4. A mass spectrometer according to claim 2, wherein the electrode means additionally include an annular electrode located after the plate electrode.

5. A mass spectrometer according to claim 4, wherein the electrode means additionally include, following the annular electrode, a cylindrical electrode having an outwardly directed flange on its end remote from the annular electrode.

6. A mass spectrometer according to claim 2, wherein the electrode means additionally include an annular electrode located before the plate electrode such that it is within said region of the vacuum chamber.

7. A mass spectrometer according to claim 6, wherein the electrode means additionally include, following the plate electrode, a cylindrical electrode having an outwardly directed flange on its end remote from the plate electrode.

8. A mass spectrometer according to claim 2, wherein the electrode means include a further plate electrode having a central aperture following said at least one electrode formed as a plate.

9. A mass spectrometer according to claim 8, wherein the electrode means including said at least one electrode are three plate electrodes having aligned central apertures.

10. A mass spectrometer according to claim 1, wherein the interface arrangement includes a passage for supplying a substance into said region for interaction with the plasma that passes through the skimmer for assisting attenuation of polyatomic and multicharged interfering ions.

11. A mass spectrometer according to claim 10, wherein the passage for supplying a substance passes through the skimmer.

* * * * *